US009631631B2

(12) United States Patent
Manchenkov

(10) Patent No.: US 9,631,631 B2
(45) Date of Patent: Apr. 25, 2017

(54) BEARING HOUSING

(71) Applicant: Alexander Manchenkov, Huntington Beach, CA (US)

(72) Inventor: Alexander Manchenkov, Huntington Beach, CA (US)

( * ) Notice: Subject to any disclaimer, the term of this patent is extended or adjusted under 35 U.S.C. 154(b) by 514 days.

(21) Appl. No.: 14/199,027

(22) Filed: Mar. 6, 2014

(65) Prior Publication Data

US 2014/0271176 A1 Sep. 18, 2014

Related U.S. Application Data

(60) Provisional application No. 61/786,061, filed on Mar. 14, 2013.

(51) Int. Cl.
*F04D 29/046* (2006.01)
*F04D 29/58* (2006.01)

(52) U.S. Cl.
CPC ..... *F04D 29/0462* (2013.01)

(58) Field of Classification Search
CPC ..... F04D 9/0462; F04D 9/0563; F04D 9/059; F04D 29/0462; F04D 29/0563; F04D 29/059
See application file for complete search history.

(56) References Cited

U.S. PATENT DOCUMENTS 4,596,476 A * 6/1986 Schill ..... F16H 57/0469 384/467
2011/0123375 A1* 5/2011 Ostergaard ..... H02K 11/21 417/423.8
2011/0158800 A1* 6/2011 Glaves ..... F04D 29/4286 415/214.1

OTHER PUBLICATIONS

Brochure, PW-11 API 610 Single State OH2 Upgrade Program, PumpWorks 610, undated, in 4 pages.
Brochure, The A-Line API 610 Heavy Duty Process Pump, Ingersoll-Dresser Pumps, 1993, in 12 pages.
Brochure, HHS-8, API 610 8th Edition, Process Pump, Union Pump Company, undated, in 8 pages.
Brochure, RV7 Back Pullout Assembly Upgrades, Ingersoll-Dresser Pump Company, 1993, in 4 pages.

* cited by examiner

*Primary Examiner* — Craig Kim
*Assistant Examiner* — Jason Davis
(74) *Attorney, Agent, or Firm* — Knobbe, Martens, Olson & Bear, LLP

(57) ABSTRACT

A bearing housing for use with a centrifugal pump can include a bracket and a cradle separated from the bracket by a gap. A plurality of ribs can connect the bracket to the cradle across the gap. The ribs can be sized and configured to improve cooling to help minimize operational temperatures of the cradle.

20 Claims, 13 Drawing Sheets

BEARING HOUSING

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. This application is related to and claims priority to U.S. Provisional Application No. 61/786,061, filed Mar. 14, 2013, the entire application of which is hereby incorporated by reference and made a part of this specification.

BACKGROUND

Field

Various embodiments disclosed herein relate generally to centrifugal overhung pumps, including but not limited to horizontal and vertical inline pumps such as API standards classifications OH1, OH2, and OH3.

Related Art

Current centrifugal overhung pumps include components and designs to help maximize operating efficiencies of the pumps, including avoiding excess operational temperatures. However, present devices contain a variety of limitations and disadvantages.

SUMMARY OF THE DISCLOSURE

Centrifugal overhung pumps, such as horizontal and vertical inline pumps, have a variety of applications and can be used, for example, in petroleum or refinery processes, petrochemical processes, gas processing, coal processing, and/or slurry and solids handling. Overhung pumps can also be configured for use with a variety of API processes, and can be adapted to meet the requirements of API standards, such as API 610, API 682, and other standards, such as HI and ANSI standards.

Various embodiments of overhung pumps include an impeller at one end of the pump that may help drive movement of a material. The impeller is typically within a pump housing. Pumps often include a bearing housing connected to the pump housing. The bearing housing can include a bracket portion that can be used to attach the bearing housing to the pump housing. The bearing housing can also include a cradle portion that can retain a plurality of bearings, which help allow for rotation of a shaft that drives the impeller. Many processes are performed at high temperatures such that the impeller receives a significant amount of heat from the material it pumps. Other sources of heat, such as friction, may also heat the impeller.

It is frequently desirable to help minimize the operational temperatures of various portions and components of overhung pumps. Bearings, for example, can have an increased lifespan when they operate at lower temperatures. Additionally, various regulations, safety concerns, or operational concerns may require that portions of the pump remain below certain temperatures. Thus, various pumps include designs to help cool the pump, and in particular the bearing housing, such as by promoting heat transfer away from the pump and bearing housing. In some instances, this can be accomplished by including a shroud around at least a portion of the pump and a fan to help drive air along the body of the pump, promoting convection heat transfer. In some instances, cooling water can be run over a portion of the pump. Both of these cooling techniques, however, require additional expense in the form of energy output and/or the necessity for additional components. Additionally, in the case of cooling water, regulations often require the water to be filtered before it can be dumped. This is commonly done by reverse osmosis or other processes that can be quite expensive. Thus, a pump design, or a design for various components of the pump, that can help maximize efficient cooling of the pump can help minimize operational costs for many pump procedures.

Various embodiments described herein relate to an improved bearing housing that dramatically limits heat transfer from the bracket of the bearing housing to the cradle of the bearing housing and that improves cooling of the bracket. This can significantly decrease operating temperatures within the cradle relative to current bearing housing designs. Various embodiments described herein include a bearing housing with a gap separating the cradle from the bracket. A plurality of ribs can connect the cradle to the bracket across the gap. This can improve the ability of the bracket to cool. It can also minimize heat transfer from the bracket to the cradle.

In various embodiments, bridging ribs between a cradle and a bracket of a bearing housing serve to isolate bearings from heat of a pump. The ribs also create additional surface area for heat to escape in form of convectional and radiant heat loss. In addition, in some embodiments hollow channels that pass through lubricating oil or a lubricant reservoir allow for additional air cooling. These various features can in some embodiments eliminate the need for a cooling fan and/or cooling water.

In various embodiments, a centrifugal overhung pump can include a shaft defining a longitudinal axis of the pump, the shaft having a proximal end and a distal end; an impeller at the distal end of the shaft; a pump housing having an inlet and an outlet, wherein at least a portion of the impeller is within the pump housing; and a bearing housing attached to the pump housing. The bearing housing can include a central channel that receives at least a portion of the shaft, a distal portion that is attached to the pump housing and that includes a distal face and a proximal face, and a proximal portion that houses a plurality of bearings between an outer wall of the proximal portion and the shaft and that includes a distal face and a proximal face. A plurality of ribs can connect the distal portion to the proximal portion, the ribs defining a gap between the proximal face of the distal portion and the distal face of the proximal portion.

In some embodiments, the pump housing can include a pump casing and a casing cover. In some embodiments, the bearing housing can include a length from the distal face of the distal portion to the proximal face of the proximal portion, the ribs can have a length, and the ratio of the width to the length width can be between approximately 20 and approximately 40. In some embodiments, the bearing housing can be formed monlithically. In some embodiments, the plurality of ribs can all either be generally horizontally aligned or generally vertically aligned. In some embodiments, a heat sink can be positioned about the shaft. The heat sink can include a plate that is positioned entirely between the distal portion of the bearing housing and the proximal portion of the bearing housing. In some embodiments, a lubrication ring that has a circumferential notch on its outer surface can be positioned around the shaft. In some embodiments, the lubrication ring can also have a chamfer on either side of its outer surface. In some embodiments, the bearing housing can include an oil reservoir and an enclosed cooling channel can pass through the reservoir, with opposite ends of the enclosed cooling channel communicating with an exterior of the bearing housing.

In various embodiments, a bearing housing for use with a centrifugal pump can include a first portion having an outer wall that defines an interior of the first portion, a first end that is configured to attach to a pump casing, and a second end opposite the first end. The first portion can be configured to receive a pump shaft inserted through the bearing housing and that passes through the first end and the second end. The bearing housing can also include a second portion adapted to house a plurality of bearings and positioned adjacent the first portion. The second portion can have a first side and a second side opposite the first side, the first side closer to the second end than the second side is to the second end, and when the pump shaft is inserted through the bearing housing the pump shaft can pass through the first side and the second side. The bearing housing can also include a gap separating the first portion and the second portion and a plurality of ribs extending across the gap and joining the first portion and the second portion. In some embodiments, the bearing housing can also include an oil reservoir and an enclosed cooling channel that passes through the reservoir.

In some embodiments, the second portion can include a plurality of exterior ridges configured to assist in heat transfer from the second portion. In some embodiments, at least some of the exterior ridges are also ribs extending across the gap and joining the first portion and the second portion. In some embodiments, the bearing housing can include an oil reservoir within the second portion. In some embodiments, an enclosed cooling channel can pass through the oil reservoir and can communicate with an exterior of the second portion.

In various embodiments, a bearing housing for use with a centrifugal pump can include a bracket configured to connect the bearing housing to a pump housing and to receive a portion of a pump shaft passing through the bearing housing, a cradle configured to retain a plurality of bearings between an outer wall of the cradle and a portion of the pump shaft passing through the bearing housing, and a connecting section joining the cradle and the bracket, the connecting section having an outer wall that defines an interior space configured to receive a portion of the pump shaft passing through the bearing housing, and a plurality of slots extending through the outer wall to the interior space to allow airflow through the interior space. In some embodiments, the bearing housing can include an oil reservoir. In some embodiments, an enclosed cooling channel can pass through the oil reservoir and can communicate with an exterior of the oil reservoir.

Various embodiments described herein also relate to an improved lubrication or flinger ring, which can be used to ensure a consistent spread of oil within a bearing housing. Flinger rings are generally positioned about a pump shaft and have a section within a lubricant reservoir of a bearing housing. The rings rotate with the shaft and spread lubricant from the reservoir within the bearing housing. In various embodiments, flinger rings can have different cross-sectional profiles that lead to more stability as they rotate and improved distribution of lubricant.

DETAILED DESCRIPTION

Various embodiments described herein relate to designs of pumps and pump components that can help maximize cooling from an end of the pump that receives a material to an end of the pump that houses bearings in a shaft of the pump. Although various embodiments may be illustrated and discussed with respect to overhung pumps, it is understood that they may equally apply to inline pumps.

Figure 1:
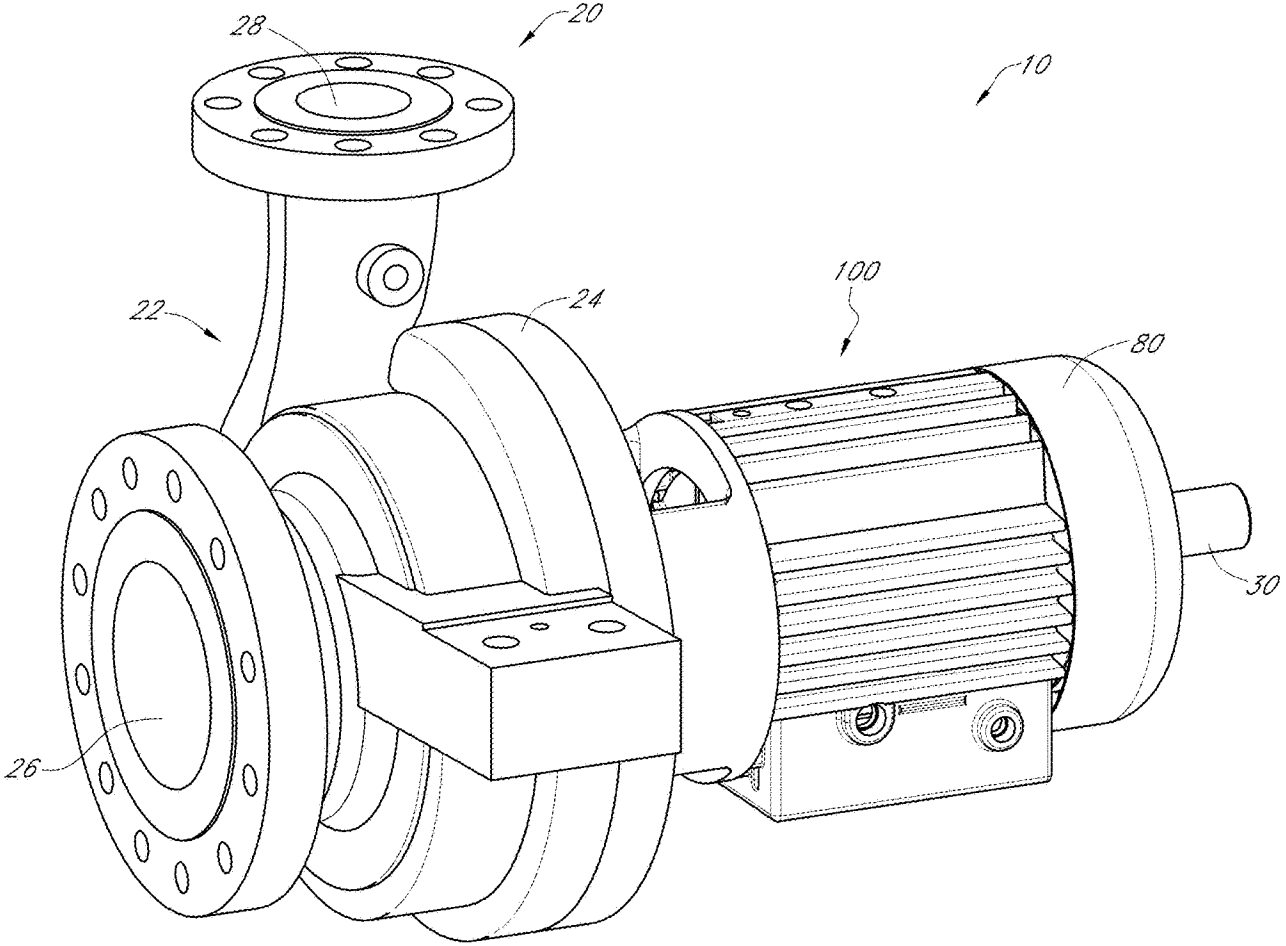
FIG. 1 is a front perspective view of one embodiment of an overhung pump.

FIG. 1 illustrates one embodiment of a pump assembly 10 adapted to help minimize an operational temperature of a bearing housing 100 and bearings within the housing. The pump assembly can include the bearing housing 100 and a pump housing 20. In some embodiments, the pump housing can include a pump casing 22 and a cover 24. The pump casing and cover can be attached to each other according to a variety of configurations known in the art. The pump housing can also include an inlet 26 and an outlet 28.

FIG. 1 also illustrates an embodiment of a pump that includes a shroud 80. In some embodiments, a shroud 80 can be attached to the bearing housing and can include a fan 82 that can help distribute cooling air across the bearing housing. FIG. 1 also illustrates a shaft 30, which can pass through the bearing housing and can connect to an impeller within the pump housing.

Figure 2:
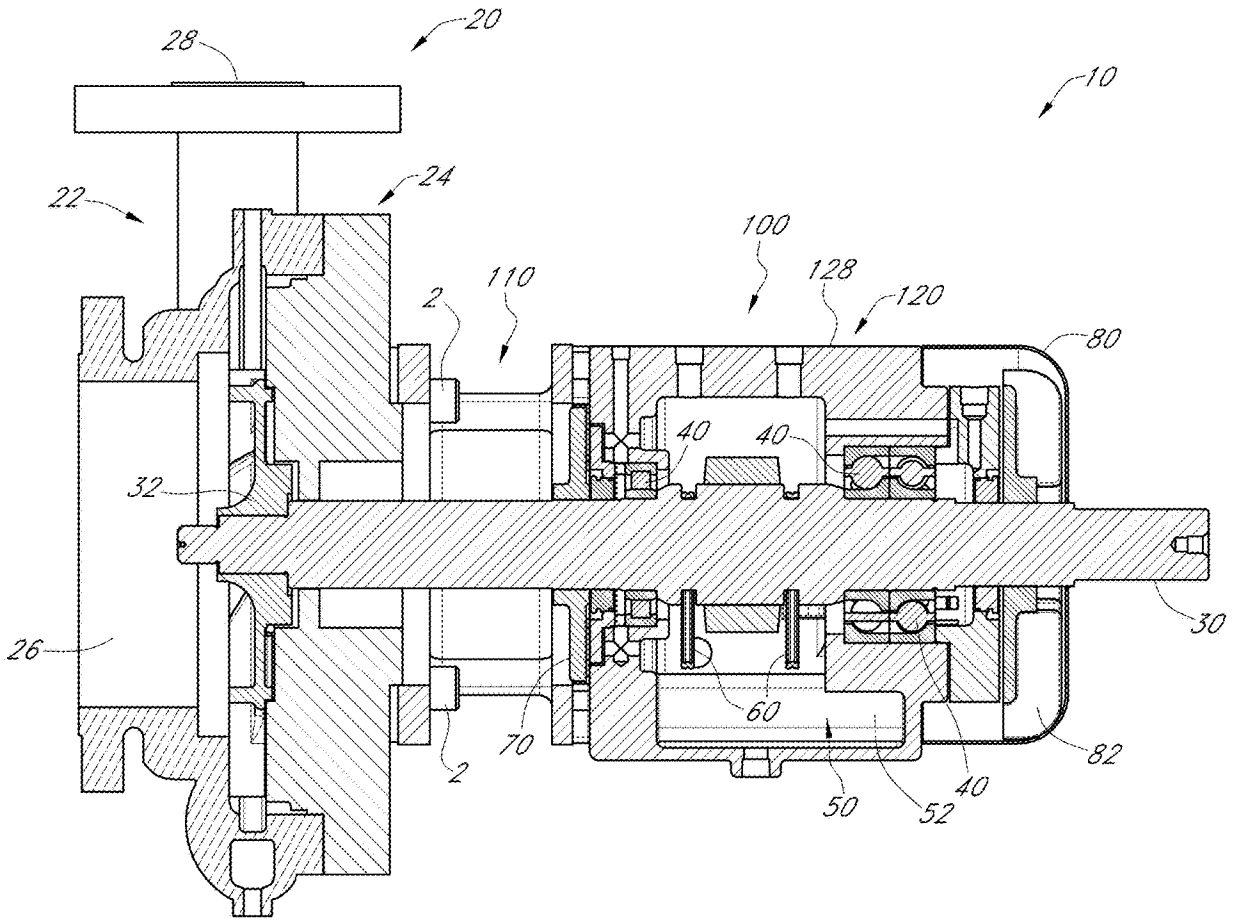
FIG. 2 is a cross-sectional view of the overhung pump of FIG. 1.

FIG. 2 illustrates a cross-sectional view of one embodiment of the pump assembly 10. In various embodiments, the bearing housing 100 can be removably attached to the pump housing 20, such as with bolts 2 or other attachment mechanisms. This can make it easier to maintain, repair, and/or replace the bearing housing itself and/or various components within the bearing housing. For example, bearings can wear down over time, particularly when operating at high temperatures and may need to be replaced. The bearing housing can be designed according to standard dimensions to make it easier to replace the bearing housing of existing and installed pump assemblies. Thus, according to some embodiments, bearing housings 100 described herein can be used to retrofit existing pump assemblies to include an improved bearing housing.

The bearing housing 100 preferably includes a first portion or bracket 110 at a distal end of the housing and a second portion or cradle 120 toward a proximal end of the housing. In some embodiments the bearing housing can be formed monolithically. In some embodiments, the bracket and cradle can be formed separately. The bracket can be adapted to provide access to bolts 2 or other attachment mechanisms that help retain the bearing housing to the pump housing. In some embodiments, the bracket can also retain a seal, such as a mechanical seal, that can seal with the pump housing.

FIG. 2 also shows an embodiment of a shaft 30 that extends through a central channel of the bearing housing 100 and attaches to an impeller 32 within the pump housing 20. One or more sets of bearings 40 can be positioned within the bearing housing to help assist with smooth and efficient rotation of the shaft. In various embodiments, a variety of bearings can be used, such as standard deep groove ball bearings, radial bearings, and/or cylindrical roller bearings, depending upon the necessary radial loads or other pump requirements. Preferably, the bearings are positioned within the cradle 120. They can be positioned within an interior of the cradle defined by an outer wall 128 of the cradle.

In some embodiments, a bearing housing can also have components configured to help provide lubrication to the shaft and/or the bearings. Thus, for example, in some embodiments a bearing housing can include a lubricant or oil reservoir 50. In some embodiments, an "oil level" line can be provided on the outside of the oil reservoir, such as by being cast as part of the bearing housing. One or more lubrication or flinger rings 60 can be positioned around the shaft and can rotate with the shaft. One end of the flinger rings can be within the lubricant, and as they rotate with the shaft the flinger rings can help distribute the lubricant within the bearing housing. In various embodiments, the flinger rings can have particular profiles that can help maximize their ability to distribute lubricant and to rotate efficiently about the shaft. In some embodiments, as described in more detail below, the lubricant reservoir 50 can include one or more cooling channels 52 that pass through the lubricant reservoir and can help cool the lubricant. The cooling channels can have openings on either end that communicate with an exterior of the bearing housing to allow air to flow through the channels.

Figure 3B:
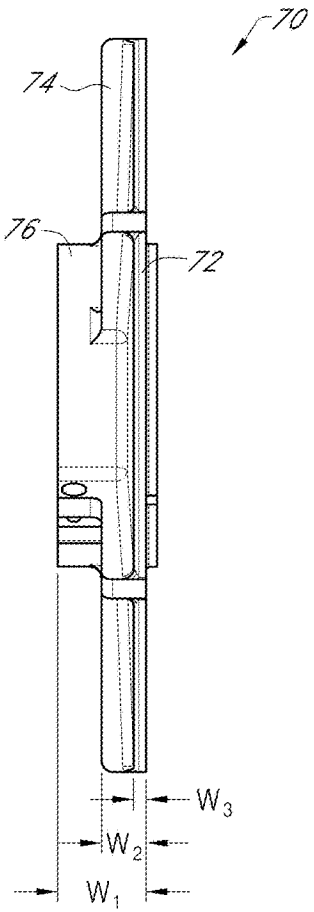
FIG. 3B is a side view of the heat sink of FIG. 3A.
Figure 3A:
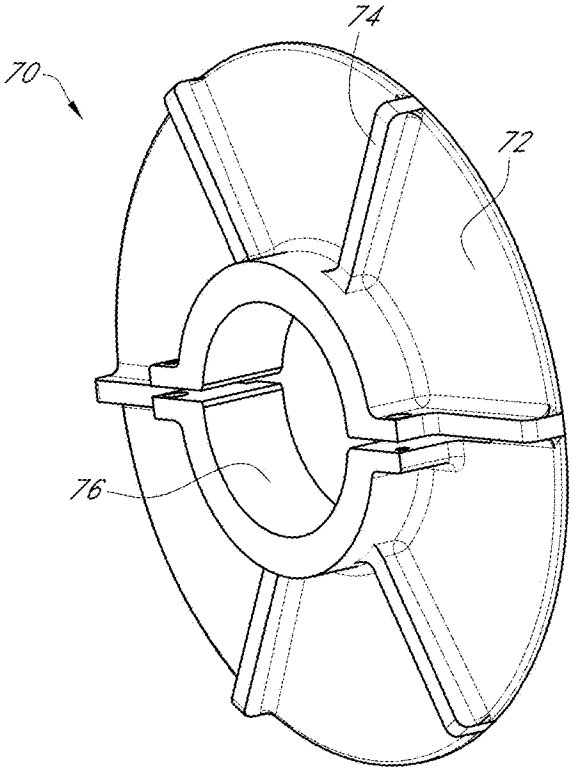
FIG. 3A is a perspective view of one embodiment of a heat sink.

In some embodiments, the pump assembly 10 can include a heat sink 70 positioned between the cradle 120 and the distal end of the bearing housing 100. The heat sink can help minimize temperatures within the cradle, such as at the bearings, by absorbing a portion of the heat that flows from the pump housing toward the bearing housing and shaft. FIGS. 3A and 3B illustrate one embodiment of a heat sink 70. FIG. 3A is a perspective view and FIG. 3B is a side view of the heat sink. In some embodiments, a heat sink can comprise a plate 72, one or more radial ribs 74, and a collar 76 that can be configured to position the heat sink about the shaft. In various embodiments, described in more detail below, the location of the heat sink on the shaft can help enhance cooling of the bearing housing. In various embodiments, also described in more detail below, certain dimensions of the heat sink can be relevant to help cool the bearing housing. In some embodiments, the heat sink can have a width $w_1$, as illustrated, between a distal end of the collar and a proximal end of the plate. The ribs 74 can have a width $w_2$ between a distal end of the ribs and the proximal end of the plate. Similarly, the plate itself can have a width $w_3$ between a distal end of the plate and a proximal end of the plate.

Figure 4:
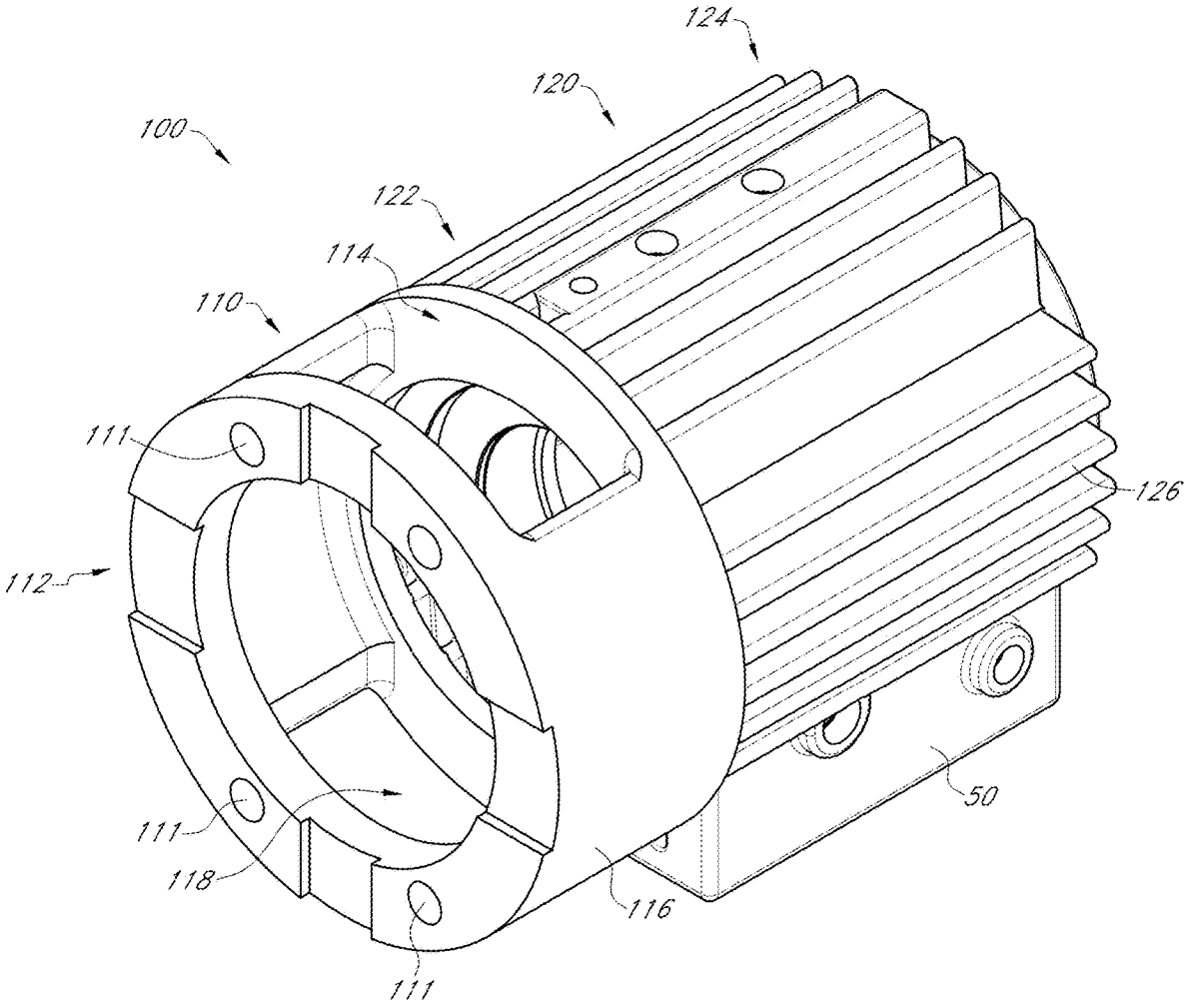
FIG. 4 is a perspective view of one embodiment of a bearing housing.

FIG. 4 illustrates one embodiment of a bearing housing 100 that can be designed to help minimize temperatures within the cradle 120. The bracket 110 can have a first or distal end 112 and a second or proximal end 114. The distal end can include mounting apertures 111 that can be used to mount the bearing housing to a pump housing. The bracket can also include one or more access openings 118 in an outer wall 116 of the bracket. The access openings can provide access to an interior of the bracket and anything within the bracket, such as a mechanical seal. In some embodiments, the access openings can also provide access to the mounting apertures 111 and any bolts or other attachment mechanisms passing through them. In some embodiments, the access openings can be sized according to applicable standards requirements, such as API 682.

The cradle 120 can include a first or distal end 122 and a second or proximal end 124. In some embodiments, the cradle can also include a plurality of cradle ribs or fins 126, which can help maximize heat transfer from the cradle to the environment. Preferably, the cradle includes ribs on at least both sides and the top of the cradle.

Figure 5A:
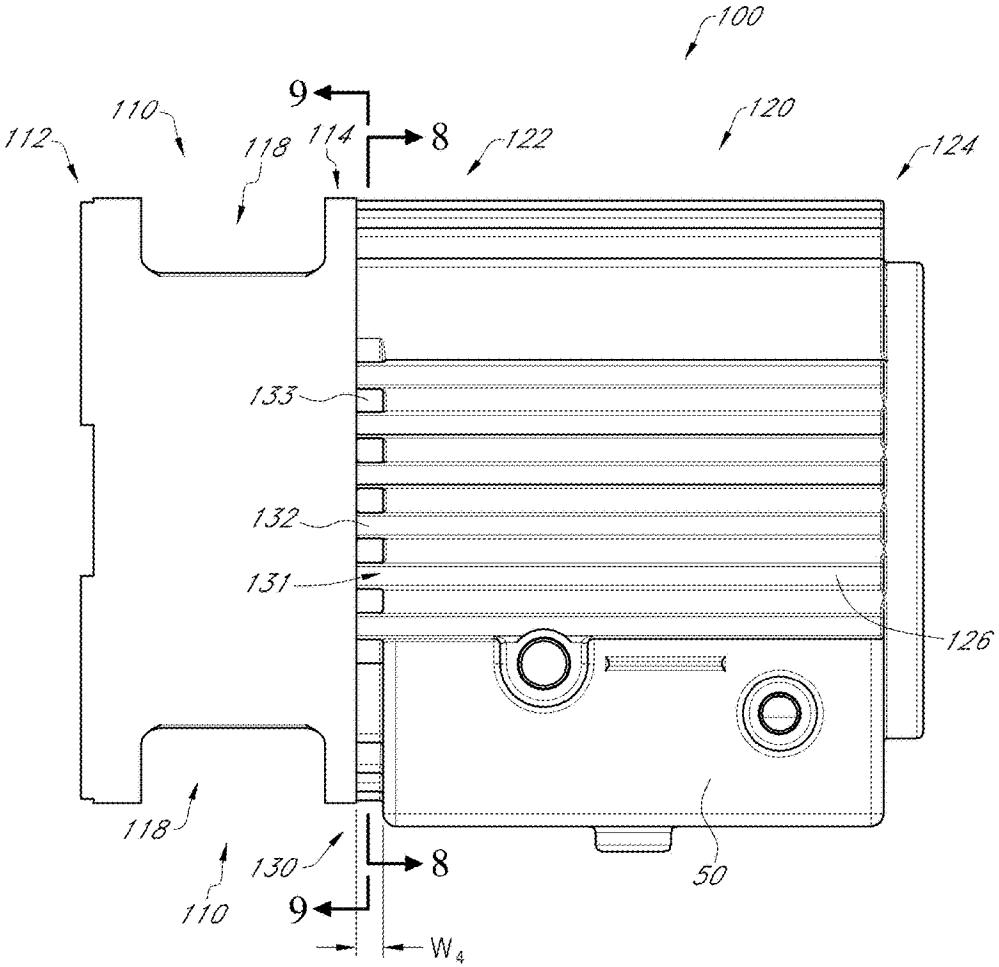
FIG. 5A is a side view of the bearing housing of FIG. 4.
Figure 5B:
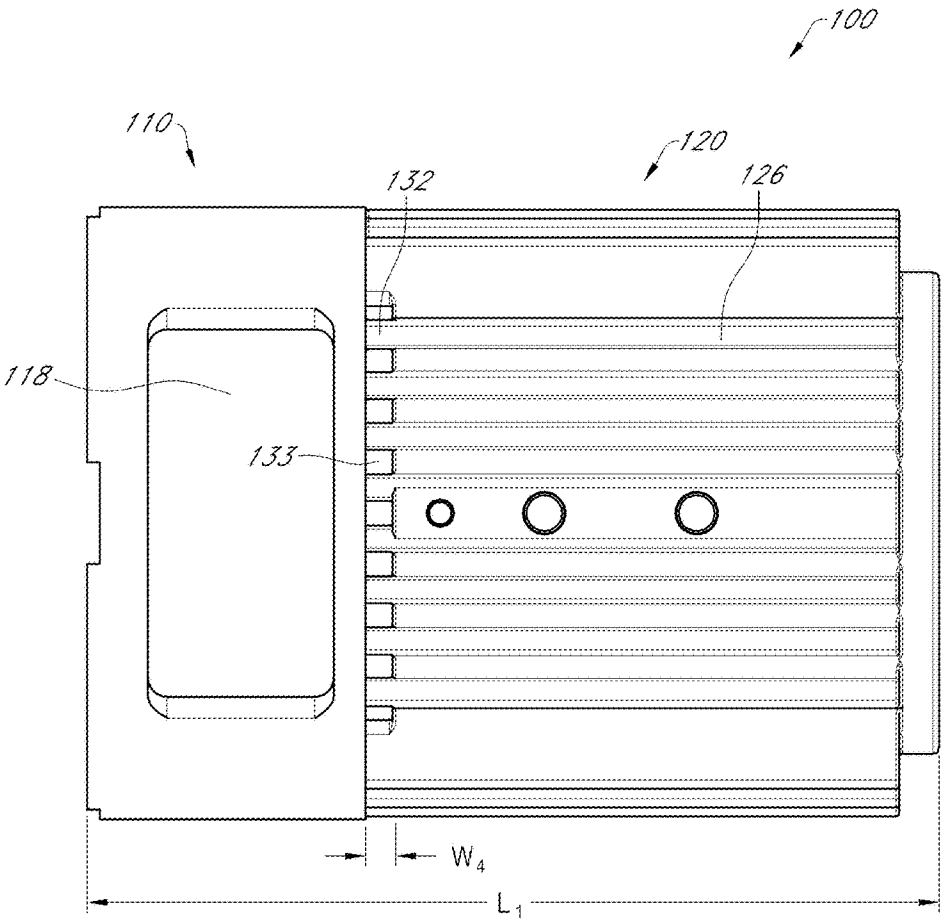
FIG. 5B is a top view of the bearing housing of FIG. 4.

FIG. 5A illustrates a side view of the bearing housing 100 and FIG. 5B illustrates a top view of the bearing housing. As illustrated in FIGS. 5A and 5B, in some embodiments a bearing housing can include a separation or gap 130 between the bracket 110 and the cradle 120. Providing a gap as described according to various embodiments herein can dramatically decrease the operating temperatures within the bearing housing. In some embodiments, the bracket and cradle can be connected to each other across the gap by bridging ribs 132, which can be separated by openings or slots 133. In some embodiments, some of the bridging ribs can be integrally formed with one or more of the cradle ribs 126. In some embodiments, all of the cradle ribs 126 can extend across the gap as bridging ribs 132.

In some embodiments, the bridging ribs 132 can be considered to define an outer wall 131 of a connecting section between the bracket 110 and the cradle 120. Openings or slots 133 can pass to an interior of the connection section. In some embodiments, such as shown in FIG. 5A, one or more openings 133 between bridging ribs 132 on a first side of the bearing housing can be aligned with openings 133 on an opposing side of the bearing housing (i.e., positioned about 180 degrees apart). This can help improve cooling of the bracket 110 and cradle 120.

In some embodiments, the openings or slots 133 can comprise varying percentages of the total outer surface area of the outer wall 131 of the section connecting the bracket 110 and the cradle 120. For example, a percentage of 0% would indicate that the outer wall 131 lacks a single opening 133. A percentage of 100% would indicate that there is no outer wall surface. In some embodiments, openings 133 can be at least 20% of the total surface area of the outer wall 131. In some embodiments, openings 133 can be at least 30% of the total surface area of the outer wall 131. In some embodiments, openings 133 can be at least 50% of the total surface area of the outer wall 131. In some embodiments, openings 133 can be at least 70% of the total surface area of the outer wall 131.

Referring to FIG. 5B, in some embodiments, the width $w_4$ of the gap 130 can affect the effectiveness of the gap in lowering the operating temperature within the cradle 120. In some embodiments, the relationship between the width $w_4$ of the gap and the length $L_1$ of the bearing housing 100 can affect how well the bearing housing cools. For example, in some embodiments the ratio of the length $L_1$ to the width $w_4$ can be between approximately 5 and approximately 70. In some embodiments, the ratio of the length $L_1$ to the width $w_4$ can be between approximately 10 and approximately 60. In some embodiments, the ratio of the length $L_1$ to the width $w_4$ can be between approximately 15 and approximately 50. In some embodiments, the ratio of the length $L_1$ to the width $w_4$ can be between approximately 20 and approximately 40. In some embodiments, the ratio of the length $L_1$ to the width $w_4$ can be between approximately 25 and approximately 35.

In some embodiments, as illustrated in FIG. 2, the gap 130 (and any ribs spanning the gap) can be aligned or partially aligned with the heat sink 70. In some embodiments, the width $w_4$ of the gap can be at least as wide as certain portions of the heat sink and those portions of the heat sink can be aligned with the gap. This can make it easier for heat absorbed by the heat sink to dissipate away from the bearing housing 100 instead of passing into the cradle 120. Thus, for example, in some embodiments the width $w_4$ can be greater than or equal to the width $w_1$ of the heat sink 70 (illustrated in FIG. 3B) and the portion of the heat sink defined by the width $w_1$ can be aligned with the gap. In some embodiments, the width $w_4$ can be greater than or equal to the width $w_2$ of the heat sink 70, and the portion of the heat sink defined by the width $w_2$ can be aligned with the gap. In some embodiments, the width $w_4$ can be greater than or equal to the width $w_3$ of the heat sink 70, and the portion of the heat sink defined by the width $w_3$ can be aligned with the gap. In some embodiments, the width $w_4$ of the gap 130 can be less than the width $w_3$ of the heat sink.

Figure 6:
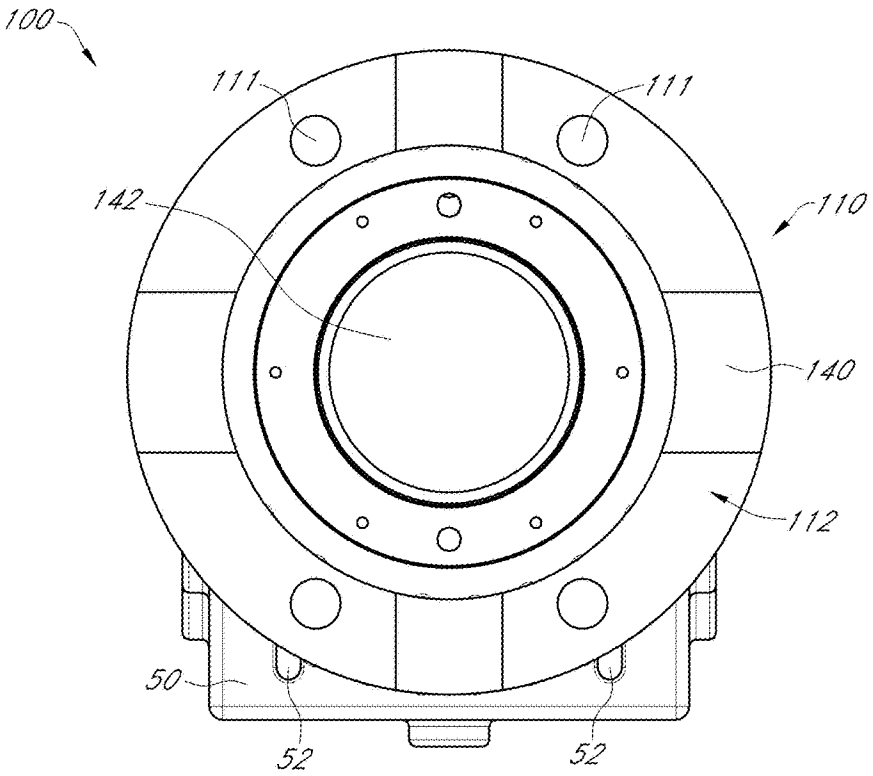
FIG. 6 is a front view of the bearing housing of FIG. 4.

FIG. 6 illustrates a front view of the bearing housing 100. FIG. 6 also illustrates a distal face 140 of the bracket 110. The distal face can include a central opening 142 that can be configured to receive a shaft as shown and described above. The distal face can also include one or more mounting apertures 111, also described above. FIG. 6 also illustrates an opening to the cooling channels 52 that pass through the lubricant reservoir 50.

Figure 7:
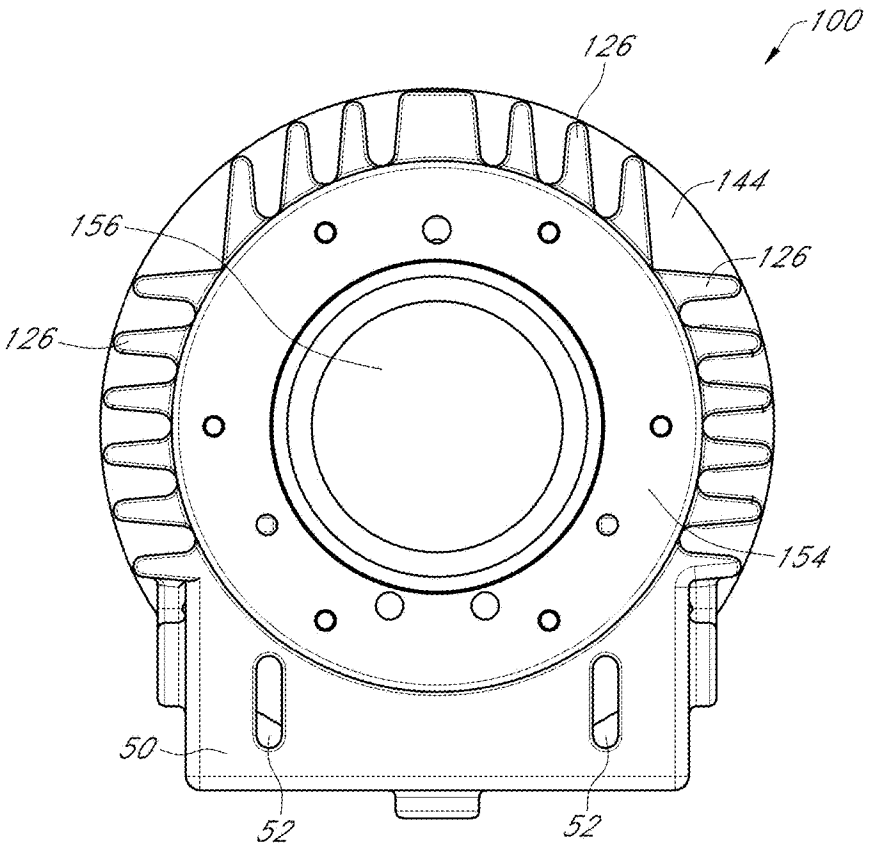
FIG. 7 is a rear view of the bearing housing of FIG. 4.

FIG. 7 illustrates a back or rear view of the bearing housing 100. FIG. 7 also illustrates the proximal face 154 of the cradle 120 of the bearing housing. The proximal cradle face 154 can include a central opening 156 through which the shaft can also pass. FIG. 7 also illustrates the cradle ribs 126. In some embodiments, as illustrated, the cradle ribs can extend outward into alignment with an outer perimeter of a proximal face 144 of the bracket. In some embodiments, one or more of the cradle ribs can extend past the outer perimeter of the proximal bracket face. In some embodiments, one or more of the cradle ribs may not extend completely to the outer perimeter of the proximal bracket face.

FIG. 7 also shows the cooling channels 52, which can pass entirely through the reservoir 50. In some embodiments, as illustrated, a bearing housing 100 can include two cooling channels. In some embodiments, a bearing housing can have one or no cooling channels, and in some embodiments a bearing housing can have more than two cooling channels. In various embodiments, the cooling channels can have a variety of profiles. Preferably, the cooling channels are shaped to maximize the available surface area for cooling. Thus, as illustrated, in some embodiments the cooling channels can be elongated, generally rectangular slots. In some embodiments they can be oriented generally vertically, in some embodiments they can be oriented generally horizontal, and in some embodiments they can be oriented at an angle. In various embodiments, the cooling channels can have cross-sectional profiles that are oval-shaped, round, square, or of other shapes.

Figure 8:
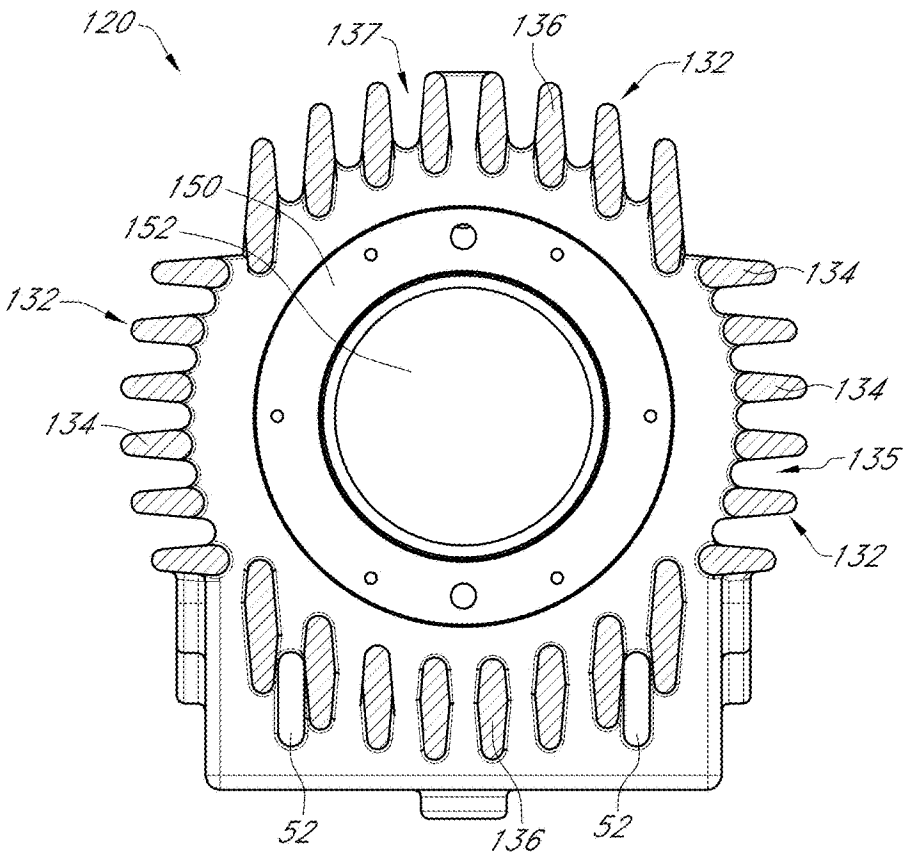
FIG. 8 is a cross-sectional view of the bearing housing of FIG. 4 taken along the line 8-8 of FIG. 5A.
Figure 9:
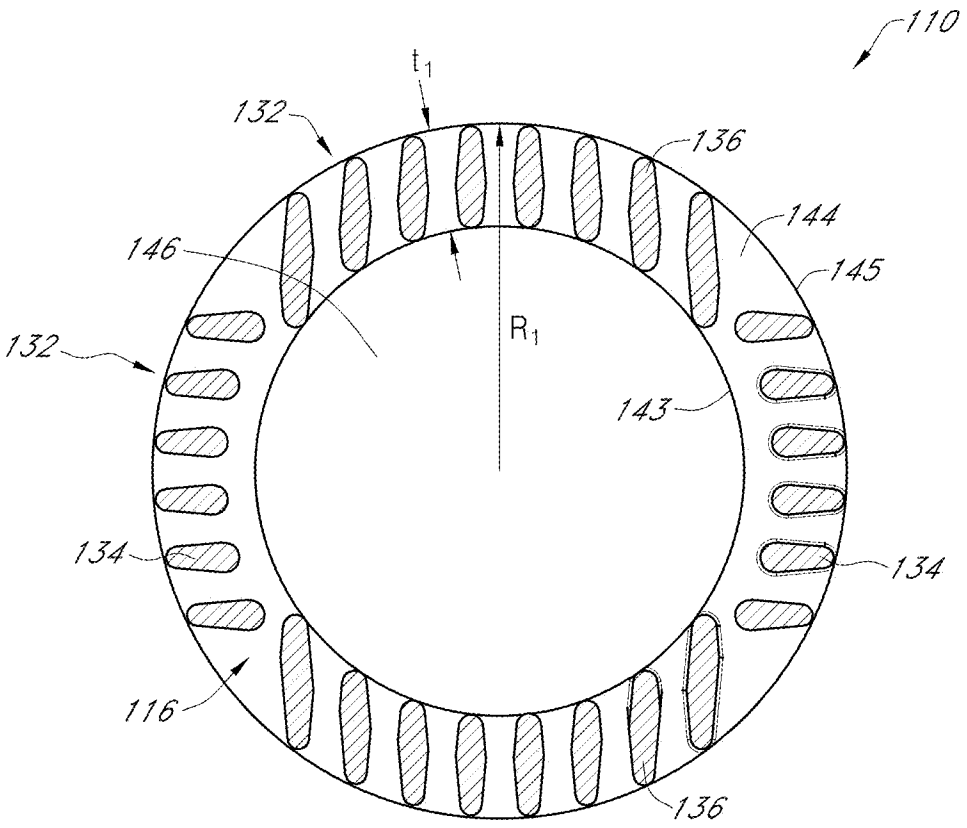
FIG. 9 is a cross-sectional view of the bearing housing of FIG. 4 taken along the line 9-9 of FIG. 5A.

FIGS. 8 and 9 illustrate cross-sectional views of the bearing housing 100 taken at the gap 130. FIG. 8 is a cross-sectional view identified by the line 8-8 in FIG. 5A, and FIG. 9 is a cross sectional view identified by the line 9-9 in FIG. 5A. FIG. 8 illustrates a distal face 150 of the cradle 120 and an opening 152 in the distal face. FIG. 8 also illustrates ribs 132 that bridge the gap between the cradle and the bracket.

In some embodiments, the bridging ribs 132 can include side bridging ribs 134 and top and bottom bridging ribs 136. In some embodiments, the bearing housing 100 can include just side ribs, just top ribs, just bottom ribs, or just top and bottom ribs. In some embodiments, the side ribs 134 can be shaped and/or configured differently from the top and bottom ribs 136. For example, in some embodiments, as illustrated, side bridging ribs 134 can all have approximately the same profiles and dimensions. In some embodiments, these profiles and dimensions can be different from top and bottom ribs 136. In some embodiments, each side rib 134 can have the same size and dimension of an opposite side rib. In some embodiments, side ribs 134 and/or top and bottom ribs 136 can be narrower at an outer end of the ribs than they are at an inner end of the ribs. Thus, for example, in some embodiments, the gaps 135 between the side ribs can narrow as the gaps get closer toward the opening 152 in the distal cradle face. Similarly, in some embodiments the gaps 137 between the upper ribs can narrow as the gaps get closer toward the opening 152 in the distal cradle face 150.

FIG. 9 illustrates the bridging ribs extending from a proximal face 144 of the bracket 110. In some embodiments, as described above, the outer ends of the ribs can extend to an outer surface 145 of the proximal bracket face 144. In some embodiments, such as illustrated, the inner ends of the top and bottom ribs 136 can also or alternatively extend to an inner surface 143 of the proximal bracket face 144 that defines an opening 146 within the proximal face. In some embodiments, as illustrated, an inner end of the side ribs 134 may not extend all the way to the inner surface 143 of the proximal face 144. In some embodiments, the side ribs 134 can extend to the inner surface 143.

In various embodiments, the upper and lower ribs 136 can be generally vertically oriented, and the side ribs 134 can be generally horizontally oriented, such as illustrated. In some embodiments, all of the bridging ribs 132 can be radially aligned. In other words, in some embodiments each of the ribs can be aligned with a radius extending from a longitudinal axis of the bearing housing.

FIG. 9 also illustrates a radius $R_1$ of the bracket 110 at the proximal bracket face 144. In various embodiments, efficient cooling of the bearing housing can depend upon the size of the gap 130 between the bracket 110 and cradle 120 relative to the size of the of the bracket or cradle, such as the radius $R_1$. In some embodiments, the ratio of radius $R_1$ to the gap width $w_4$ can be between approximately 5 and approximately 20. In some embodiments, the ratio of radius $R_1$ to the gap width $w_4$ can be between approximately 5 and approximately 15. In some embodiments, the ratio of radius $R_1$ to the gap width $w_4$ can be between approximately 8 and approximately 13.

In some embodiments, efficient cooling of the bearing housing can depend upon the size of the gap 130 between the bracket 110 and cradle 120 relative to the thickness $t_1$ of the outer wall 116 of the bracket 110. In some embodiments, the ratio of the thickness $t_1$ to the gap width $w_4$ can be between approximately 1 and approximately 6. In some embodiments, the ratio of the thickness $t_1$ to the gap width $w_4$ can be between approximately 2 and approximately 5. In some embodiments, the ratio of the thickness $t_1$ to the gap width $w_4$ can be between approximately 2.5 and approximately 3.5.

Figure 10:
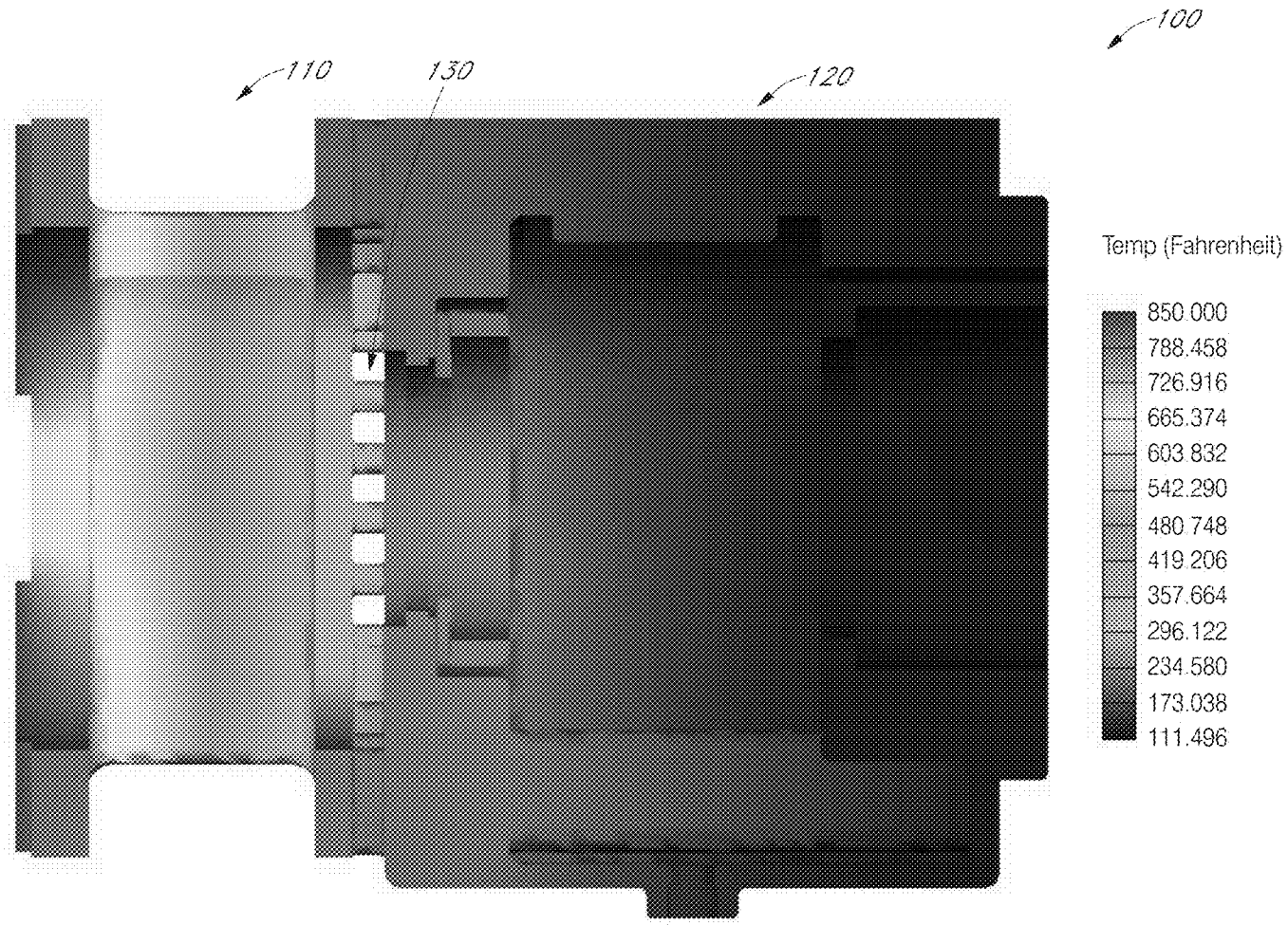
FIG. 10 is a cooling analysis of one embodiment of a bearing housing.

FIG. 10 illustrates a temperature analysis performed on one embodiment of a bearing housing 100 that includes a gap 130 between the bracket 110 and cradle 120. The analysis assumes a pumping temperature of at least 850 degrees Fahrenheit and a bearing housing in still air (i.e., without a fan or cooling water). As illustrated, the bearing housing 100 can help lower the temperature at the bracket 110 from about 850 degrees to about 180 degrees at a location where bearings would be positioned within the cradle 120. This temperature distribution may not require additional cooling, or may require only a fan and/or shroud. This is a significant improvement over existing pumps, which often require the addition of cooling water at pumping temperatures of 700 degrees or below.

Figure 11:
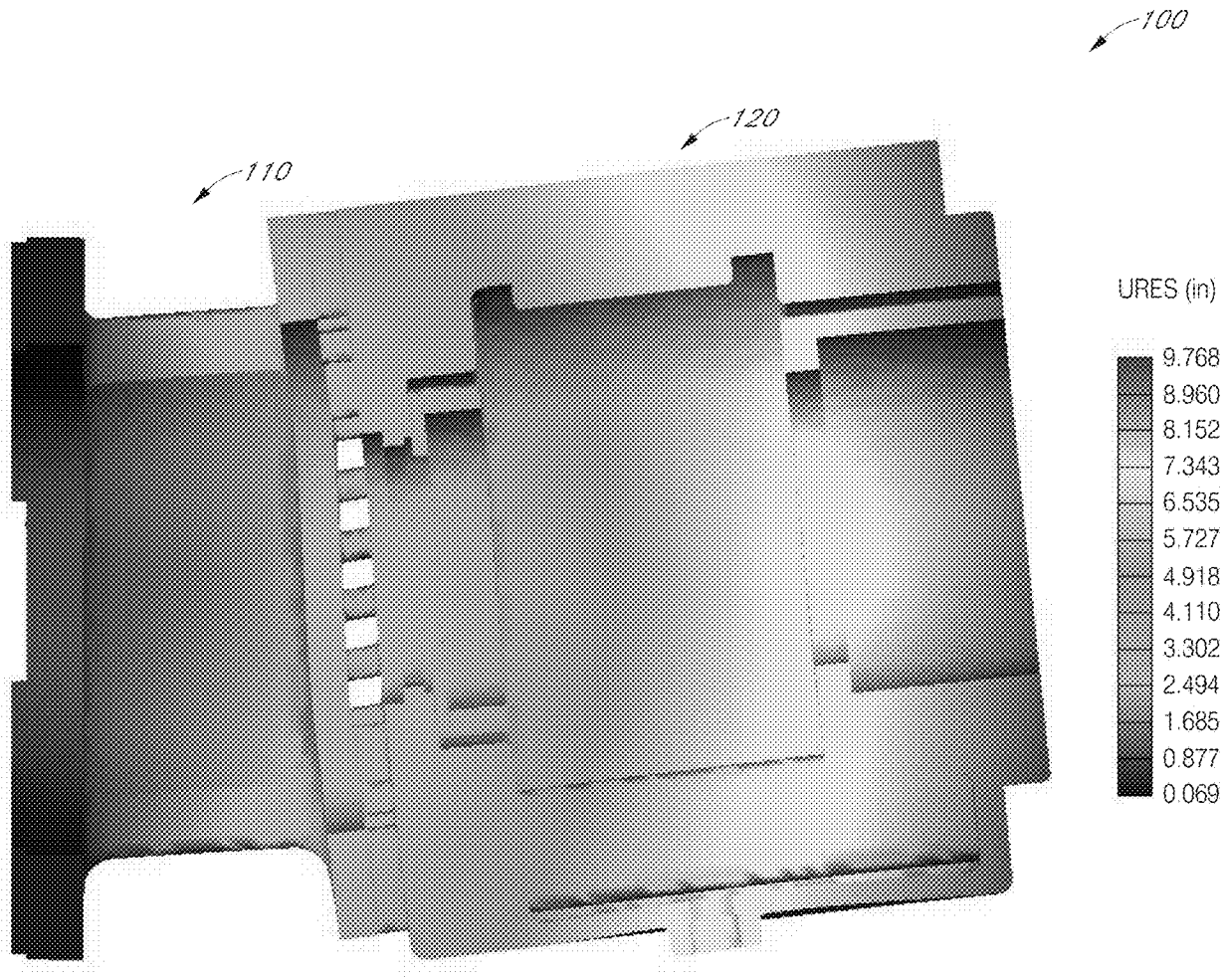
FIG. 11 is a frequency analysis of one embodiment of a bearing housing.

In various embodiments, it can be desirable to have a bearing housing 100 with natural structural frequencies that differ from operating frequencies of pumps that may be used with the bearing housing. Many pumps operate at different rotational speeds between 20 Hz and 60 Hz. Thus, for example, it may be desirable for a bearing housing to have a natural frequency that is outside of that range. This prevents potential vibration problems and can allow the bearing housing to be used with a greater variety of pumps. Various embodiments described herein have a natural frequency greater than approximately 200 Hz. In some embodiments, a bearing housing 100 may have a natural frequency greater than approximately 300 Hz. In some embodiments, a bearing housing 100 may have a natural frequency greater than approximately 400 Hz. In some embodiments, a bearing housing 100 may have a natural frequency approximately equal to 433 Hz. In some embodiments, a bearing housing 100 may have a natural frequency greater than approximately 440 Hz. FIG. 11 illustrates the results of a frequency analysis performed on one embodiment of a bearing housing 100 establishing a first natural frequency of approximately 443 Hz.

In some embodiments, the dimensions of the gap and/or ribs can affect the natural structure frequency of the bearing housing. For example, in some embodiments the gap can have a width $w_4$ (shown in FIG. 5A) that is between about 0.50 inches and about 1.50 inches. In some embodiments, the gap can have a width $w_4$ that is between about 0.75 and 1.25 inches. In some embodiments, the gap can have a width that is about 1.00 inches. In some embodiments, the gap width can be less than 0.50 inches or greater than 1.5 inches. In some embodiments, average thickness of the ribs can also vary. In some embodiments, the ribs can have an average thickness between about 0.10 inches and about 0.50 inches. In some embodiments, the ribs can have an average thickness between about 0.10 inches and about 0.40 inches. In some embodiments, the ribs can have an average thickness between about 0.20 inches and about 0.30 inches. In some embodiments, the ribs can have an average thickness of about 0.25 inches. In some embodiments, the ribs can have an average thickness less than about 0.10 inches or greater than about 0.50 inches.

Figure 13:
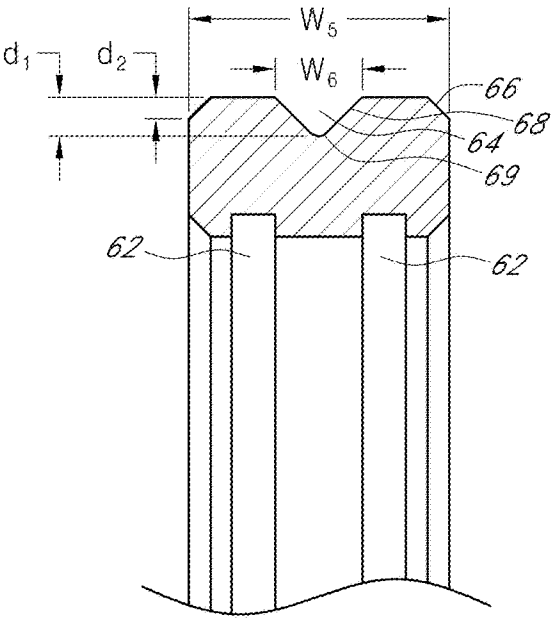
FIG. 13 is a cross-sectional view of the lubricant ring of FIG. 12.
Figure 12:
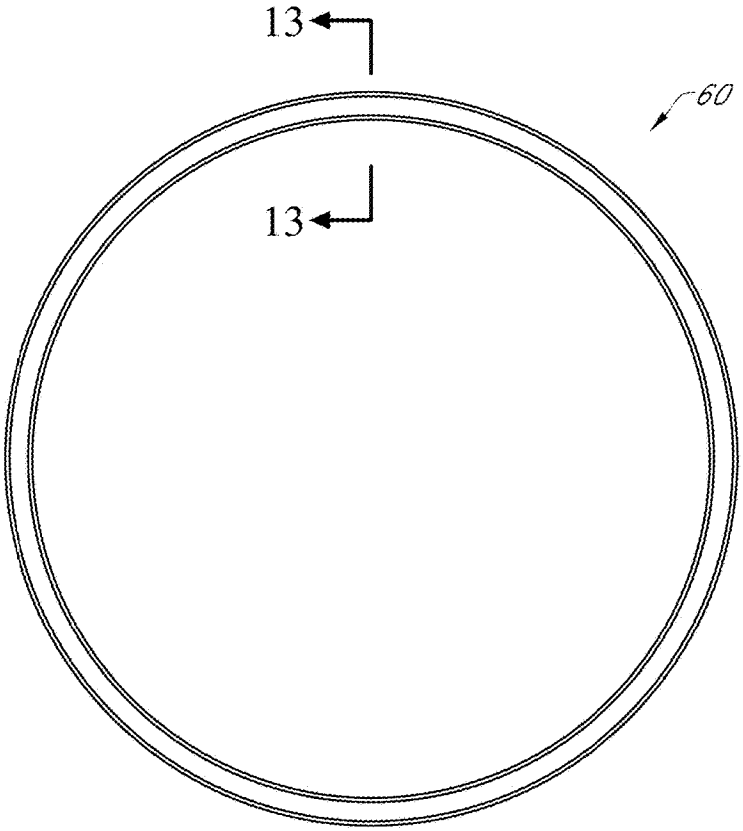
FIG. 12 is a side view of one embodiment of a lubricant ring.

In some embodiments, as described above, flinger rings can be used to distribute lubricant within the bearing housing. FIGS. 12 and 13 illustrate one embodiment of a flinger ring 60 that has been configured to improve the efficiency and effectiveness of the flinger ring. FIG. 12 illustrates a side view of the ring and FIG. 13 illustrates a cross section of the ring. In some embodiments, a flinger ring 60 can include an outer notch 64 that extends around the circumference of the ring and can help the ring distribute oil. In some embodiments, the notch can have angled walls that extend toward each other. In some embodiments, the walls can meet each other and the notch can have a profile of a "V." In some embodiments, as illustrated, the notch walls 68 can extend toward a bottom 69. In some embodiments, the bottom can be flat. In other embodiments, it can be curved.

In various embodiments, the size of the notch 64 can affect how well the ring distributes oil. Thus, for example, in some embodiments, the width of the ring $w_5$ relative to the width of the notch $w_6$ can effect oil distribution. For example, in some embodiments the ratio of the width $w_5$ of the ring to the width $w_6$ of the notch can be between approximately 1.5 and approximately 5. In some embodiments, the ratio of the width $w_5$ of the ring to the width $w_6$ of the notch can be between approximately 2 and approximately 4. In some embodiments, the ratio of the width $w_5$ of the ring to the width $w_6$ of the notch can be between approximately 2.5 and approximately 3.5. In some embodiments, the ratio can be approximately 3.

Similarly, in some embodiments, the width of the notch $w_6$ relative to its depth $d_1$ can affect oil distribution. In some embodiments, the ratio of $w_6$ to $d_1$ can be between approximately 0.75 and approximately 2. In some embodiments, the ratio can be between approximately 1 and approximately 1.5.

In some embodiments, the ring 60 can also include a chamfer 66 on either side of its outer surface. In some embodiments, the size of the chamfer $d_2$ can be defined relative to the depth $d_1$ of the notch 64. In some embodiments, $d_2$ can be less than $d_1$, as illustrated. In some embodiments, $d_2$ can be greater than $d_1$. In some embodiments, the ratio of the depth $d_1$ of the notch 64 to the size of the chamfer $d_2$ can be between approximately 2 and approximately 4. In some embodiments, it can be between approximately 2.5 and approximately 3.5.

In some embodiments, an inner wall of the ring 60 can include one or more rectangular notches 62. The rectangular notches can help the inner ring maintain stability as it rotates with the shaft of the pump assembly. This can help generate a more constant flow of lubricant and a more consistently placed flow of lubricant within the lubricant reservoir 50.

The terms "approximately", "about", and "substantially" as used herein represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above.

Similarly, this method of disclosure is not to be interpreted as reflecting an intention that any claim require more features than are expressly recited in that claim. Rather, inventive aspects may lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A bearing housing for use with a centrifugal pump, the bearing housing comprising:

a first portion having an outer wall that defines an interior of the first portion, a first end that is configured to attach to a pump casing, and a second end opposite the first end, wherein the first portion is configured to receive a pump shaft inserted through the bearing housing and that passes through the first end and the second end;

a second portion adapted to house a plurality of bearings and positioned adjacent the first portion, the second portion having a first side and a second side opposite the first side, the first side closer to the second end than the second side is to the second end, wherein when the pump shaft is inserted through the bearing housing the pump shaft passes through the first side and the second side;

a gap separating the first portion and the second portion; and a plurality of ribs extending across the gap and joining the first portion and the second portion;

wherein the first portion further comprises an access opening, the access opening being located longitudinally between the first end and the second end, the access opening configured to enable access to the pump shaft in a radial direction, the access opening being positioned longitudinally between the first end of the first portion and the gap.

2. The bearing housing of claim 1, further comprising an oil reservoir within the second portion.

3. The bearing housing of claim 2, further comprising an enclosed cooling channel passing through the oil reservoir, wherein the enclosed cooling channel communicates with an exterior of the second portion.

4. The bearing housing of claim 1, wherein the bearing housing has a first natural structural frequency of approximately 443 Hz.

5. The bearing housing of claim 1, further comprising a heat sink configured to be coupled with the pump shaft such that the heat sink is substantially longitudinally aligned with the gap, thereby enabling heat transfer from the heat sink radially outward through the gap.

6. The bearing housing of claim 1, wherein the gap comprises a plurality of slots.

7. The bearing housing of claim 1, wherein the gap comprises a longitudinal length of between 0.50 inches and 1.50 inches.

8. The bearing housing of claim 1, wherein the bearing housing comprises a longitudinal length and the gap comprises a longitudinal length, a ratio of the longitudinal length of the bearing housing to the longitudinal length of the gap is between 10 and 60.

9. A bearing housing for use with a centrifugal pump, the bearing housing comprising:

a bracket configured to connect the bearing housing to a pump housing and to receive a first portion of a pump shaft passing through the bearing housing;

a cradle configured to retain a plurality of bearings between an outer wall of the cradle and a second portion of the pump shaft passing through the bearing housing;

a connecting section joining the cradle and the bracket, the connecting section comprising an outer wall that defines an interior space configured to receive a third portion of the pump shaft passing through the bearing housing, and a plurality of slots extending through the outer wall to the interior space to allow airflow through the interior space; and a heat sink configured to be coupled with the pump shaft such that the heat sink is substantially longitudinally aligned with the plurality of slots, thereby enabling heat transfer from the heat sink radially outward through the plurality of slots.

10. The bearing housing of claim 9, further comprising an oil reservoir.

11. The bearing housing of claim 10, further comprising an enclosed cooling channel passing through the oil reservoir, wherein the enclosed cooling channel communicates with an exterior of the oil reservoir.

12. The bearing housing of claim 9, wherein the bearing housing has a first natural structural frequency of approximately 443 Hz.

13. The bearing housing of claim 9, wherein the bracket further comprises a first end that is configured to attach to a pump casing of the centrifugal pump, a second end opposite the first end, and an access opening, the access opening being located longitudinally between the first end and the plurality of slots.

14. The bearing housing of claim 9, wherein the heat sink comprises a radially inner collar configured to engage with the pump shaft, a radially outwardly extending plate, and a plurality of ribs.

15. The bearing housing of claim 9, further comprising a plurality of bridging ribs that extend across the connecting section in a direction that is substantially parallel with a longitudinal axis of the bearing housing.

16. The bearing housing of claim 15, wherein the cradle further comprises a plurality of cradle ribs that are configured to facilitate transfer of heat from the cradle, the plurality of cradle ribs being integral with the plurality of bridging ribs.

17. A bearing housing for use with a centrifugal pump, the bearing housing comprising:

a first portion having an outer wall that defines an interior of the first portion, a first end that is configured to attach to a pump casing, and a second end opposite the first end, wherein the first portion is configured to receive a pump shaft inserted through the bearing housing and that passes through the first end and the second end;

a second portion adapted to house a plurality of bearings and positioned adjacent the first portion, the second portion having a first side and a second side opposite the first side, the first side closer to the second end than the second side is to the second end, wherein when the pump shaft is inserted through the bearing housing the pump shaft passes through the first side and the second side;

a gap separating the first portion and the second portion; and a plurality of ribs extending across the gap and joining the first portion and the second portion, wherein the plurality of ribs extend across the gap substantially parallel with a longitudinal axis of the bearing housing.

18. The bearing housing of claim 17, wherein the gap comprises a plurality of slots.

19. The bearing housing of claim 17, further comprising a heat sink configured to be coupled with the pump shaft such that the heat sink is substantially longitudinally aligned with the gap, thereby enabling heat transfer from the heat sink radially outward through the gap.

20. The bearing housing of claim 19, wherein the heat sink comprises a plurality of ribs having a longitudinal width, wherein a longitudinal width of the gap is greater than or equal to the longitudinal width of the ribs.

* * * * *